US012667755B2

(12) United States Patent
Clutter et al.

(10) Patent No.: US 12,667,755 B2
(45) Date of Patent: Jun. 30, 2026

(54) FRICTION ENHANCED AND ADJUSTABLE 'Y' GRIP DOORFRAME PULLUP BAR

(71) Applicants: John Clutter, Irving, TX (US); Alireza Yazdanshenas, Richardson, TX (US)

(72) Inventors: John Clutter, Irving, TX (US); Alireza Yazdanshenas, Richardson, TX (US)

(73) Assignee: Sun Six Innovation LLC, Dover, DE (US)

( * ) Notice: Subject to any disclaimer, the term of this patent is extended or adjusted under 35 U.S.C. 154(b) by 0 days.

(21) Appl. No.: 18/668,189

(22) Filed: May 19, 2024

(65) Prior Publication Data

US 2025/0352850 A1 Nov. 20, 2025

(51) Int. Cl.
*A63B 23/12* (2006.01)

(52) U.S. Cl.
CPC ..... *A63B 23/1218* (2013.01); *A63B 2225/09* (2013.01)

(58) Field of Classification Search
CPC ..... A63B 21/1618; A63B 21/1627; A63B 21/1636; A63B 21/1645; A63B 21/1654; A63B 21/1663; A63B 23/1218; A63B 2225/09
See application file for complete search history.

(56) References Cited

U.S. PATENT DOCUMENTS 5,184,992 A * 2/1993 Banks ..... A63B 21/0626 482/104
5,417,628 A * 5/1995 Vanderbleek ..... A63B 21/1636 482/40
7,108,636 B1 * 9/2006 Garcia ..... A63B 21/1627 482/141
10,780,311 B1 * 9/2020 Gadd ..... A63B 21/00047
11,964,180 B1 * 4/2024 Li ..... A63B 17/04
12,138,504 B1 * 11/2024 Wang ..... A63B 23/1218
2012/0046150 A1 * 2/2012 Stacey ..... A63B 23/0216 482/131
2016/0166874 A1 * 6/2016 Sheeler ..... A63B 1/00 482/40

(Continued)

FOREIGN PATENT DOCUMENTS

CN 203874380 U * 10/2014
CN 106110594 A * 11/2016 ..... A63B 23/1218

(Continued)

*Primary Examiner* — Gary D Urbiel Goldner

(74) *Attorney, Agent, or Firm* — Bold IP, PLLC; Houda El-Jarrah

(57) ABSTRACT

A doorway pullup bar is presented comprising an ability to safely and firmly rest on a header of a doorframe, whereby a friction strip is added to an underside of a cross-beam that extends between a first angle bar and a second angle bar of the doorway pullup bar. Further, the doorway pullup bar provides improved grip variety so that a user can engage with the same doorway pullup bar to securely perform a greater variety of exercises including chip ups, hammer pulls, and pullups in a variety of configurations. A left hand grip bar and a right hand grip bar each include two sets of holes that are adjustable by the user depending on the type of exercise to be performed and the type of training sought. The doorway pullup bar is adjustable to accommodate a variety of thicknesses and widths of doorframes.

4 Claims, 19 Drawing Sheets

(56) References Cited

U.S. PATENT DOCUMENTS

| | | | | |
|---|---|---|---|---|
| 2017/0354838 | A1* | 12/2017 | Fitzpatrick | A63B 1/00 |
| 2021/0339076 | A1* | 11/2021 | Gadd | A63B 21/1636 |

FOREIGN PATENT DOCUMENTS

| | | | | | |
|---|---|---|---|---|---|
| CN | 205948291 | U | * | 2/2017 | |
| DE | 202020102771 | U1 | * | 6/2020 | A63B 21/4035 |
| WO | WO-2024220875 | A1 | * | 10/2024 | A63B 23/1218 |

* cited by examiner

FRICTION ENHANCED AND ADJUSTABLE 'Y' GRIP DOORFRAME PULLUP BAR

TECHNICAL FIELD

The disclosure relates generally to a doorframe pullup bar. In particular, the disclosure relates to a Friction Enhanced and Adjustable "Y" Grip Doorframe Pullup Bar that includes the ability to improve the frictional connection between the door frame and the Pullup Bar. Furthermore, the "Y" grip members of the pullup bar can be configured to adjust for the width of a given doorframe while also possessing the ability to be configured rotationally along the long axis of the member for additional adjustable grip options.

BACKGROUND

Several types of doorframe pullup bars exist so that a given user can either permanently or temporarily install it to a given doorframe. These pullup bars are considered general exercise devices for home fitness purposes. The main function of these devices is to give the user the ability to perform a pullup at home using the device and a given doorframe. However, the doorframes vary vastly in size and shape making it difficult for a door frame pullup bar to make ideal contact against the door and not effort has been made to improve the frictional interaction between a doorframe pullup bar and a given door frame. Furthermore, no doorframe pullup bars exist that have an axially adjustable "Y" grip option. Thus, the Friction Enhanced and Adjustable "Y" Grip Doorframe Pullup Bar provides a solution and improvement to the shortcomings of current options.

SUMMARY OF THE INVENTION

The Friction Enhanced and Adjustable "Y" Grip Doorframe Pullup Bar (FEAYP) is a doorframe pullup bar with a frictional support strip. The crossbeam of the pullup bar is the crossmember that rests on top of the doorframe and presses against the section of the wall above the door. It is important to note that the top of the door frame and the section of the wall above the door are orthogonal to each other. Ideally, the crossbeam makes normal contact with the top of the doorframe and the wall at the same time. However, because the width of the door frames varies in size and tolerance, the crossbeam is not always able to create a normal contact with both the top of the doorframe and the wall at the same time. This change from surface contact to line contact reduces the efficacy of the crossbeam members function causing additional failure risks. By introducing a friction strip to the crossbeam, to the surface of the crossbeam that contacts the top of the door frame, the crossbeam will be able to improve its frictional grip to the door frame and thereby enhance its contact interaction. This will provide additional and improved utility of the product.

Furthermore, the FEAYP can axially adjust the "Y" grip for additional variability in the pullup exercise. The "Y" grip can point downwards for a traditional "Y" grip or can be adjusted to point horizontally and parallel to the ground for additional variability. Setting the "Y" to a horizonal will target an additional variety of muscles in the forearms, upper arms, and torso thought the pullup motion.

BRIEF DESCRIPTION OF THE DRAWINGS

For a more complete understanding of this disclosure and its features, references are now made to the following description, taken in conjunction with the accompanying drawings in which:

FIG. 17.B is the FEAYP with the "Y" grip in a horizontal orientation.

FIG. 18.B shows the FEAYP in the thin Door frame configuration.

FIG. 19.B shows the FEAYP in the regular width door frame configuration.

FIG. 19.C shows the FEAYP in the narrow door frame configuration.

DETAILED DESCRIPTION OF THE FRICTION ENHANCED AND ADJUSTABLE "Y" GRIP DOOR FRAME PULLUP BAR

Figure 1:
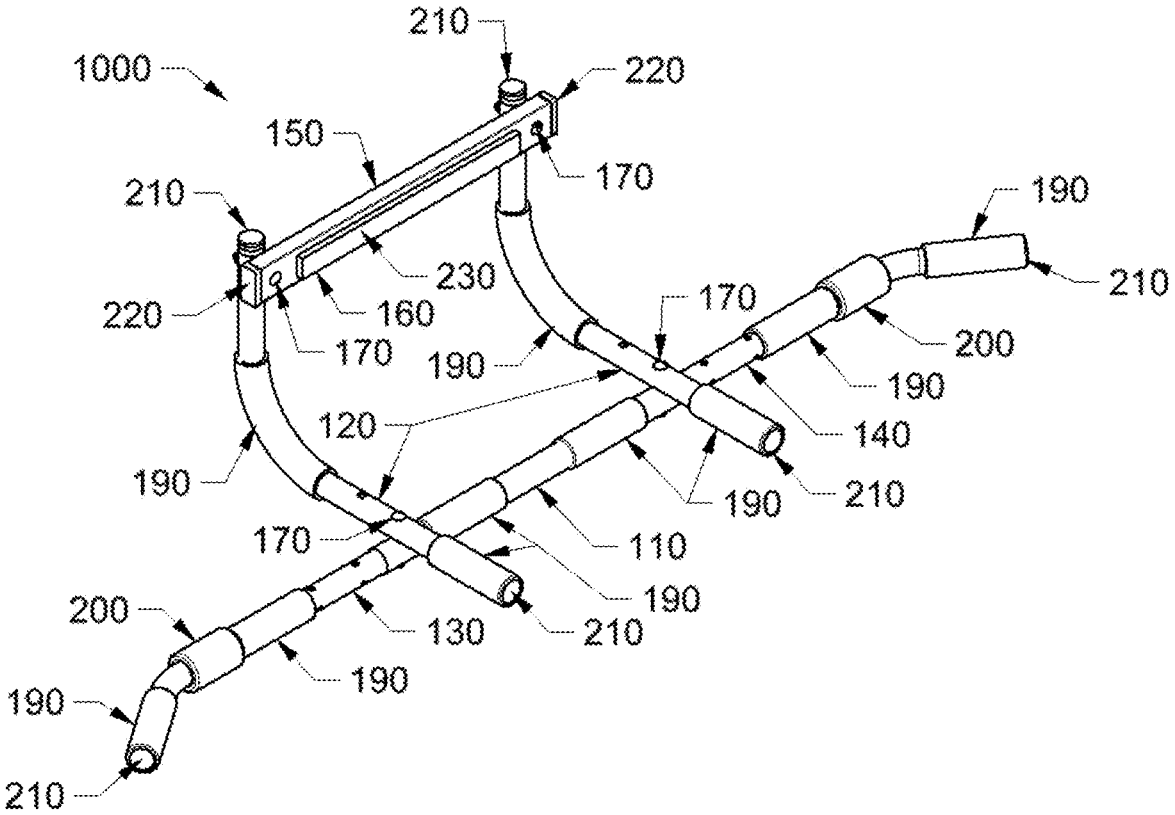
FIG. 1 is an isometric view of the FEAYP.
Figure 2:
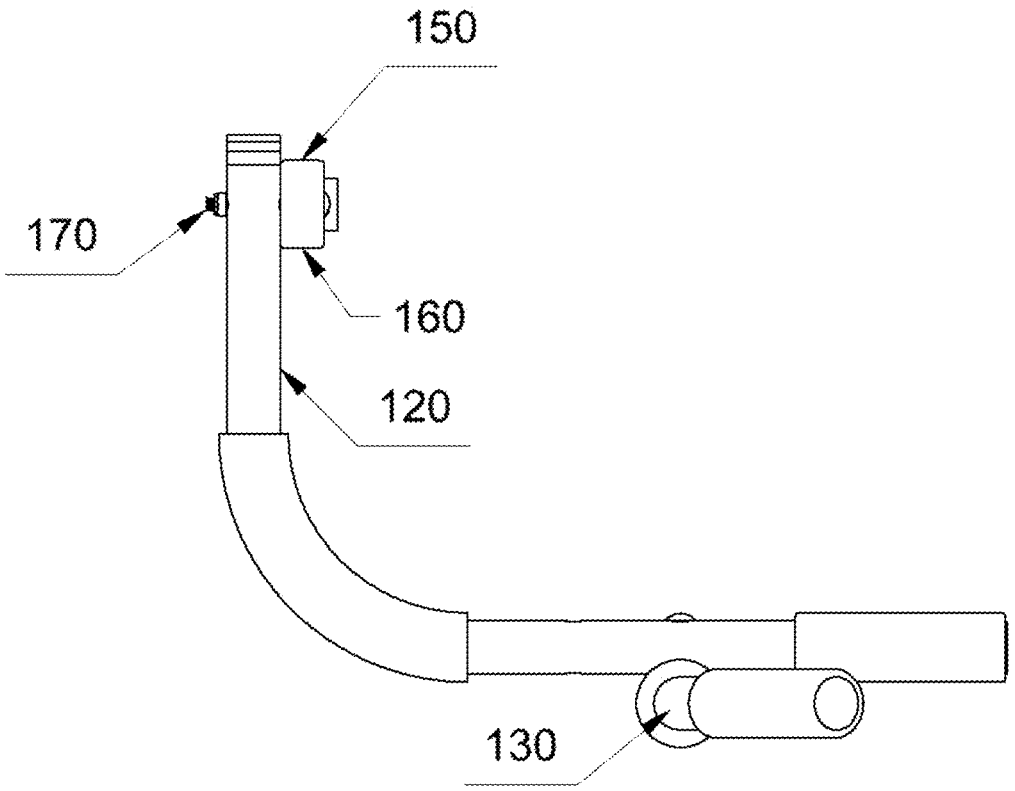
FIG. 2 is a left side view of the FEAYP.

Embodiment of the invention disclosure relates to the Friction Enhanced and Adjustable "Y" Grip Door Frame Pullup Bar (FEAYP) 1000. As shown in exemplary embodiments of FIG. 1, the FEAYP is composed of a Center Bar 110, two Angle Bars 120, a Left "Y" Grip 130, a Right "Y" Grip 140, a Crossbeam 150, and a Friction Strip 160. All other components in FIG. 1 and FIG. 2 numbered 170, 180, 190, 200, 210, 220, and 230 are exchangeable standard of the shelf components.

Figure 3:
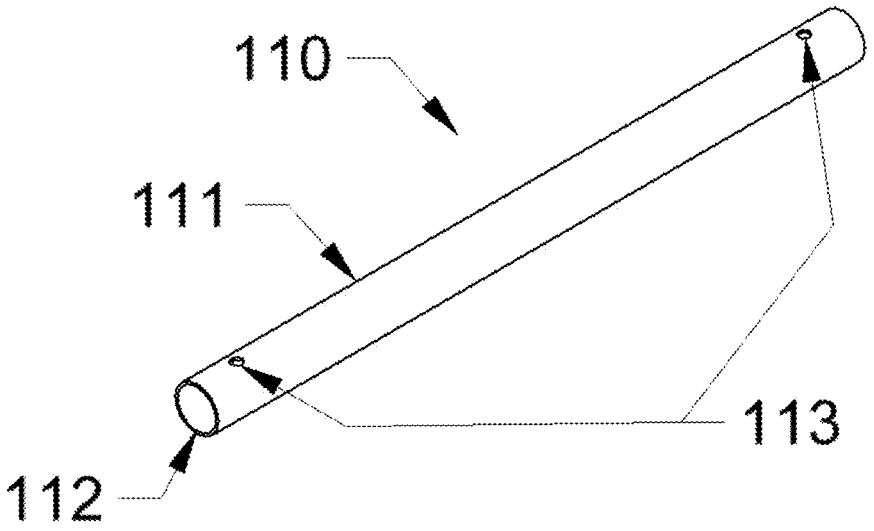
FIG. 3 is the Center Bar.

The Center Bar 110, shown in FIG. 3 is composed of an outside diameter 111 and an inside diameter 112. In addition, the Center bar has two through holes 113 for a bolt fastener to engage with. These through holes allow for the door frame width adjustments in combination with the doorframe thickness adjustment.

Figure 4:
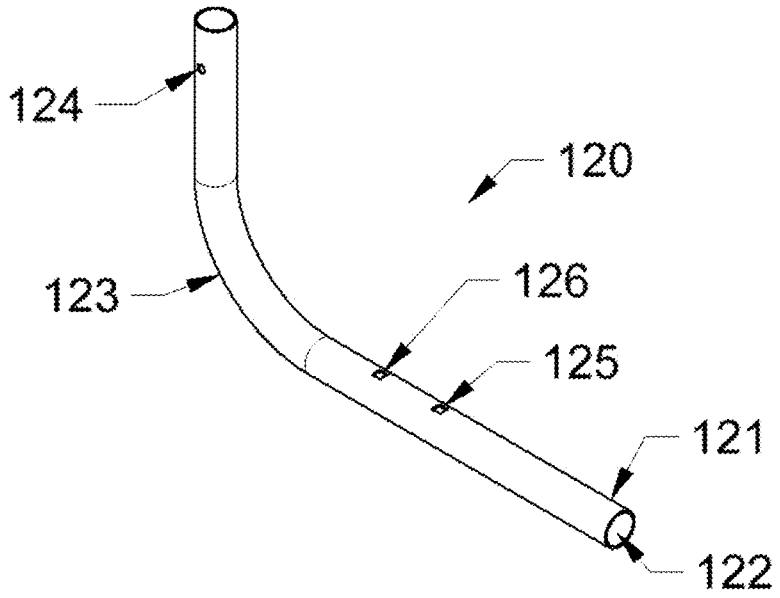
FIG. 4 is the Angle Bar.
Figure 5:
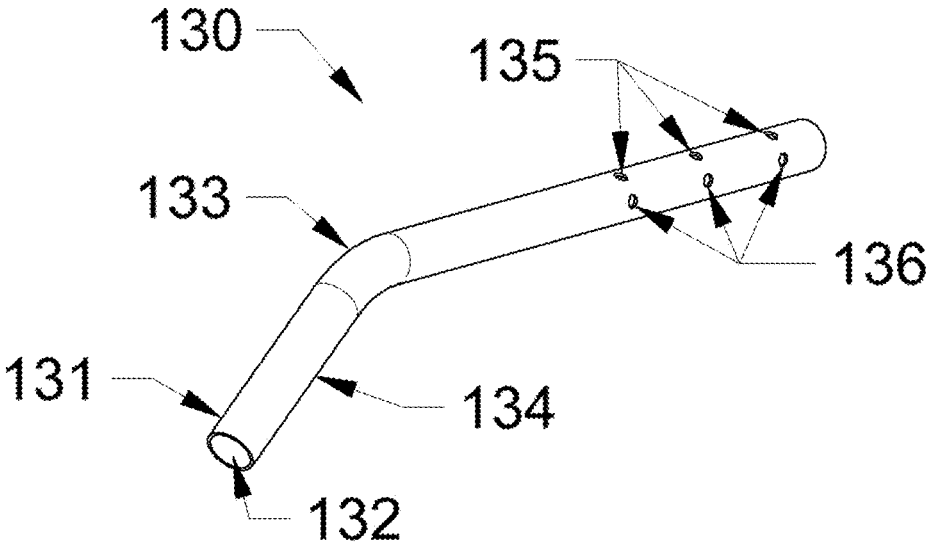
FIG. 5 is the Left "Y" Grip.
Figure 6:
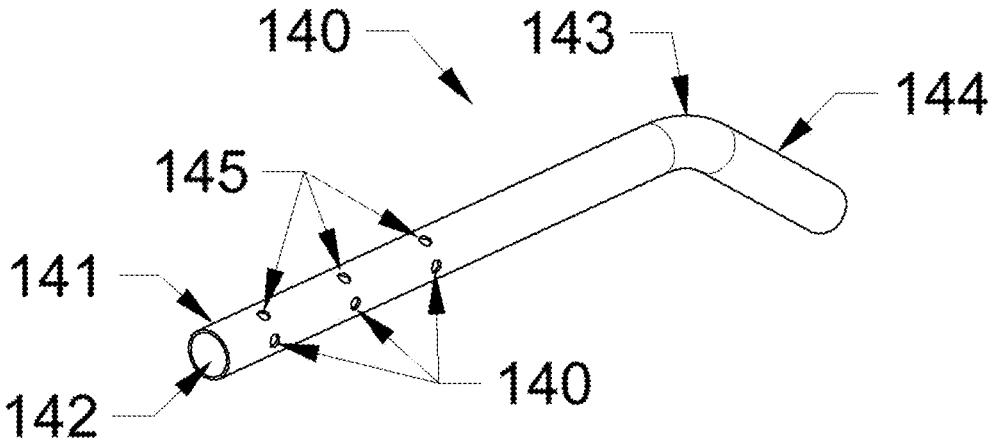
FIG. 6 is the Right "Y" Grip.

The Angle Bar 120, shown in FIG. 4 is composed of an outside diameter 121 and an inside diameter 122. The Angle Bar has a 90° bend 123 between its two endpoints. Two square through holes 125 and 126 allow the angle bar to be adjustable for a given doorframe thickness, with 125 being the option for a thicker door frame and 126 being the option for a thinner door frame. 125 and 126 are congruently used to adjust for the width of the doorframe as well. Lastly, The Angle Bar also has a round bolt/pin through hole 124 at the top end. This through hole 124 allows for the hinging mechanism of the FEAYP 1000.

The Left "Y" Grip 130 is composed of an outside diameter 131 and an inside diameter 132. There exists a bend 133 in distal end that creates an estimated 25°-45° change in angle. This change in angle creates the left "Y" grip 134. On the proximal end of 130 exist two arrays of 3 through holes. The first array of through holes 135 allow for adjustment of the width to match a given doorframe with the "Y" grip pointing towards the ground. The second array of through holes 136 allows for adjustment of the width to match a given doorframe with the "Y" grip pointing horizontal to the ground.

The Right "Y" Grip 140 is a mirror image of the Left "Y" Grip 130 with all features being mirrored and otherwise identical in form, fit, or function.

Figure 7:
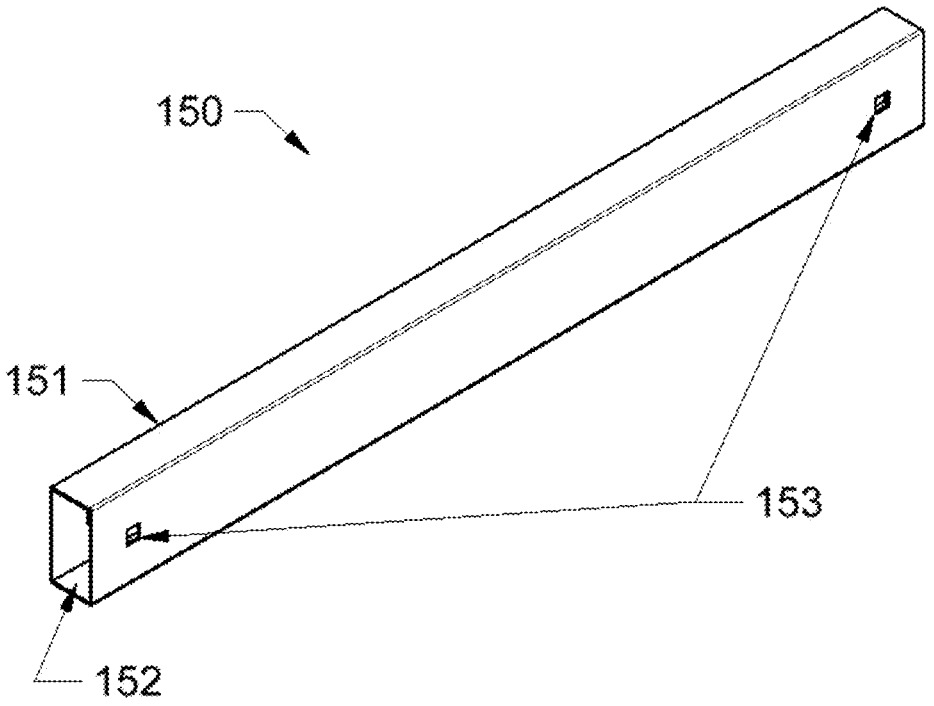
FIG. 7 is the Crossbeam.

FIG. 7 shows the Crossbeam 150. The Crossbeam is made of an outside rectangular parameter 151 and an inside rectangular parameter 152. There exist two square holes 153 on either end section of the Crossbeam. These square holes provide an anchoring point for the Square Neck Carriage Bolts.

Figure 8A:
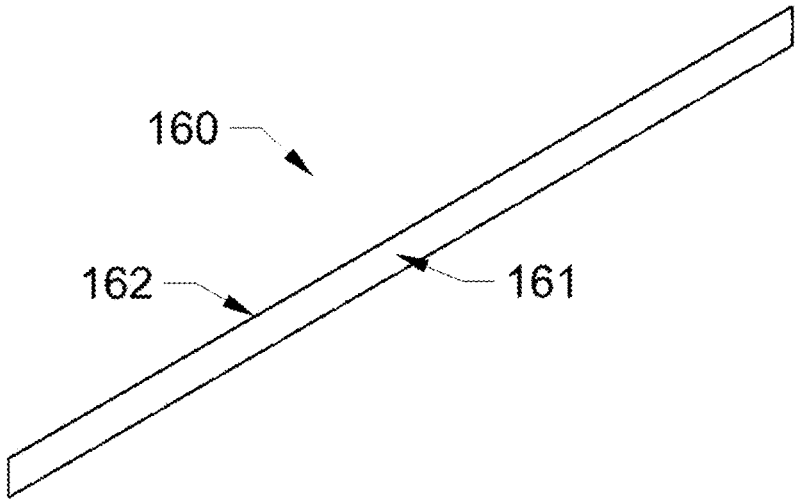
FIG. 8A is the Friction Strip.
Figure 8B:
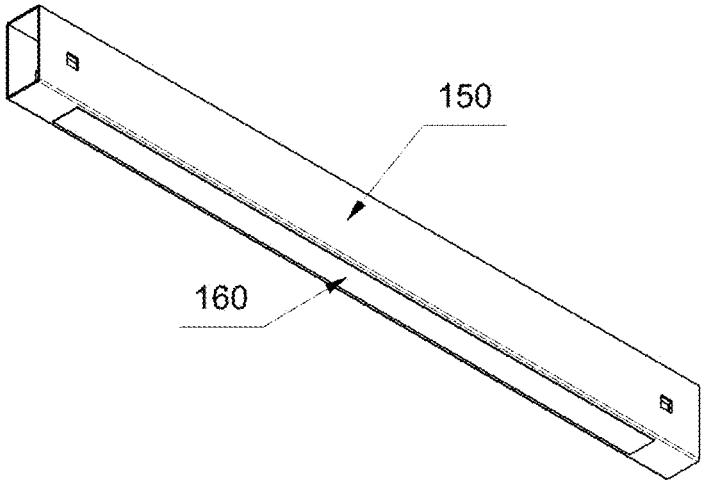
FIG. 8B shows the Fraction Stripp in respect to the Crossbeam
Figure 9:
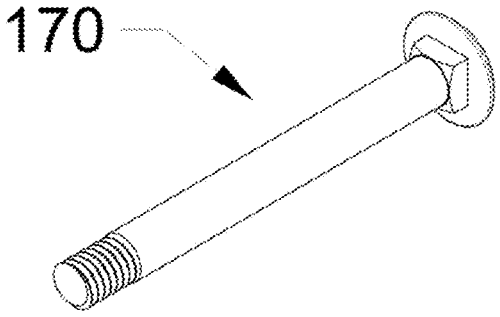
FIG. 9 is the Square Neck Carriage Bolt.
Figure 10:
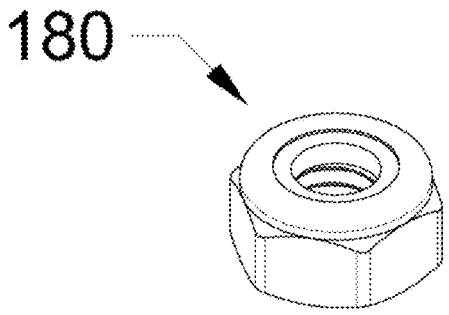
FIG. 10 is the Lock Nut.
Figure 11:
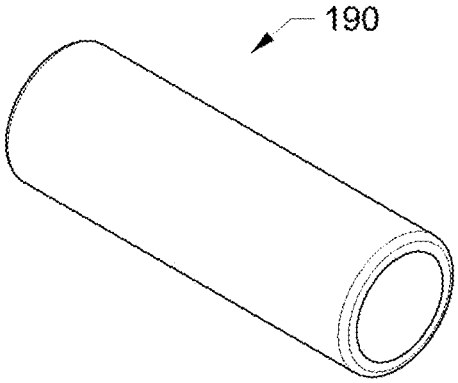
FIG. 11 is the Foam Grip.
Figure 12:
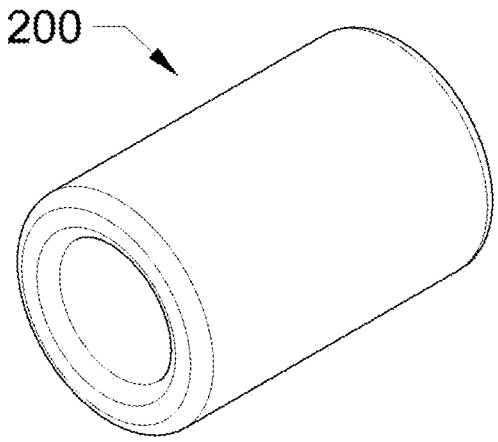
FIG. 12 is the Door Pad.
Figure 13:
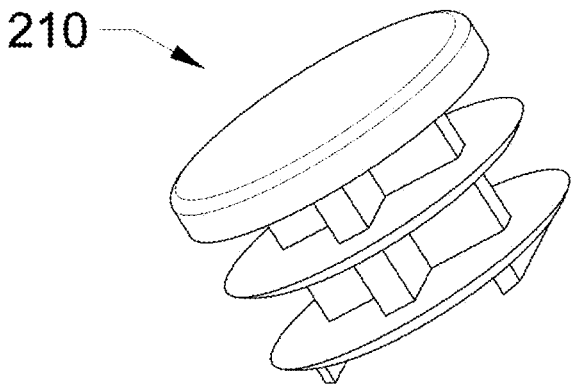
FIG. 13 is the Round Tube Plug.
Figure 14:
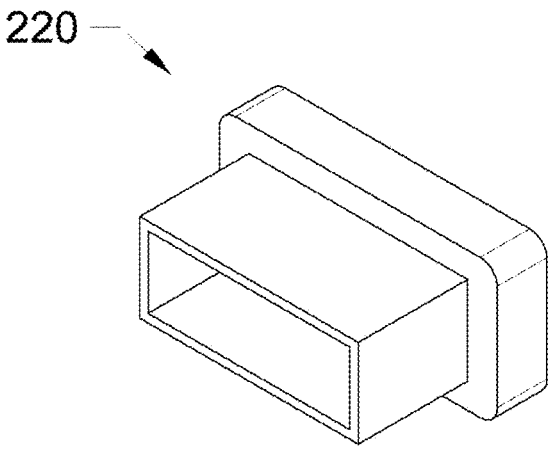
FIG. 14 is the Square Tube Plug.
Figure 15:
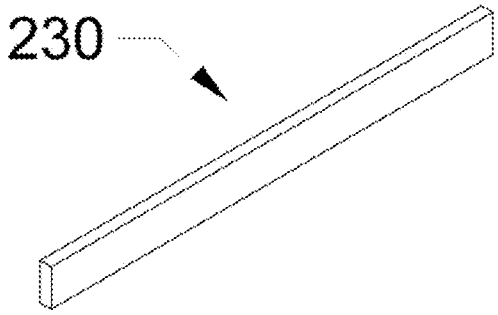
FIG. 15 is Crossbeam Padding.

FIG. 8A Shows the embodiment of the Friction Strip 160. The Friction Strip is made of an adhesive backside 162 and an abrasive front side 161. Front side 161 has an improved friction factor coefficient compared to the complementary surface of the Crossbeam 150. FIG. 8B shows the relation of the Friction Strip 160 the Crossbeam 150. The adhesive side 161 of the Friction Strip is adhered to the bottom side of the Crossbeam and the abrasive side 161 of the friction strip is facing out.

FIGS. 9 through 15 show components 170, 180, 190, 200, 210, 220, 230 respectively. These components are standard off the shelf parts that are interchangeable in the design. These components do not contribute much to the created utility of the overall design.

Figure 16:
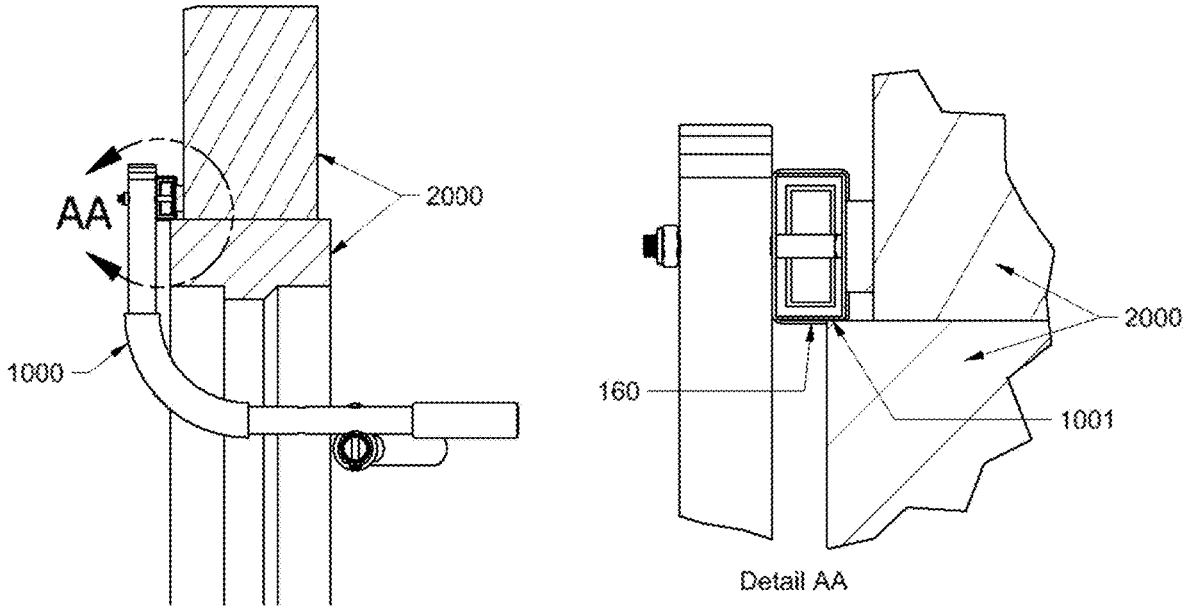
FIG. 16 Shows the Friction Strip interaction to a door frame.

FIG. 16 shows the (FEAYP) 1000 installed into a given Door Frame 2000. Detailed view AA shows the Friction Enhanced Contact 1001 between the Friction Strip 160 and the give Door Frame 2000. While the (FEAYP) 1000 is loaded with the weight of a user attempting to exercise, the load of the user is then transferred thought the body of (FEAYP) and into the Friction Strip 160. Friction Strip 160 naturally loads against the equal and opposite reaction forces provided by the Door Frame 2000. This interaction between the two surfaces, the abrasive side of the Friction Strip 161 and the give Door Frame 2000, is coined the Friction Enhanced Contact 1001.

Figure 17A:
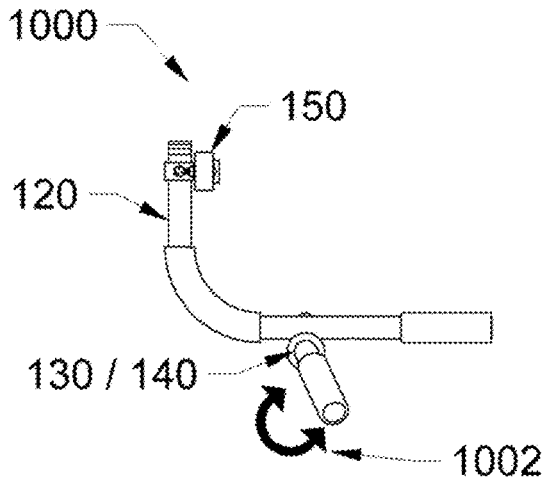
FIG. 17.A is the FEAYP with the "Y" grip in a downward orientation.
Figure 17B:
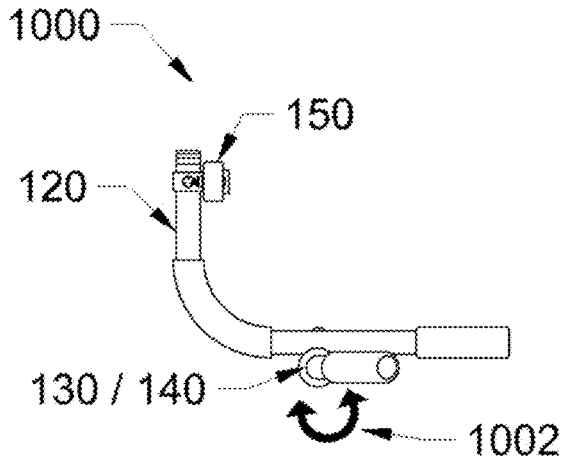

The Axially Adjustable "Y" Grip Mechanism 1002 is demonstrated in FIG. 17.A and FIG. 17.B. The downward oriented "Y" grip option is shown in FIG. 17.A in which 130 and 140 aim towards the ground. The horizontally oriented "Y" grip option is shown in FIG. 17.B in which 130 and 140 aim horizontally from the ground. There can be additional options outside of downward and horizontal that will be included in the final version of the patent.

Figure 18A:
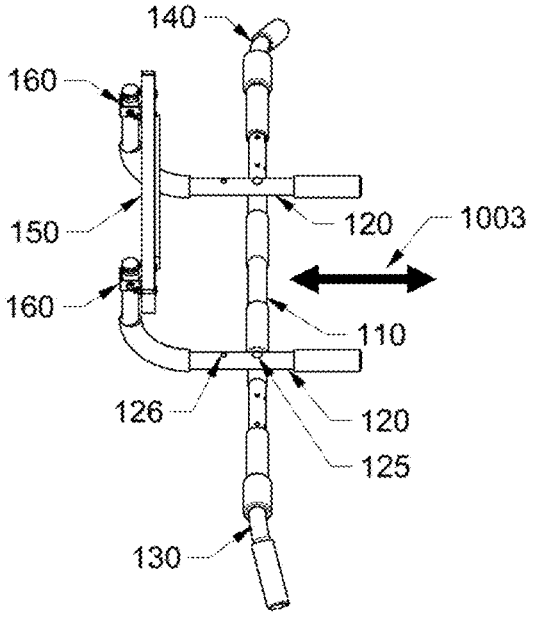
FIG. 18.A shows the FEAYP in thick door frame configuration.
Figure 18B:
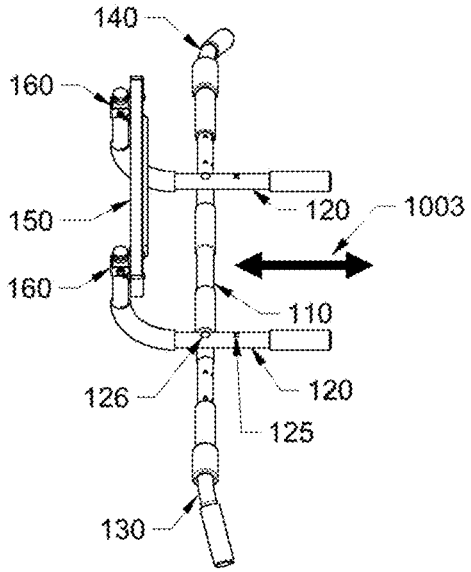

FIGS. 18.A and 18.B depict the door thickness adjustability setting 1003. In FIG. 18.A the chosen through hole of 120 is 125. This allows for 1000 to be in the thick door frame setting. FIG. 18.B shows 1000 in the thin door frame setting by which 1003 is set by chosen through hole 126 of component 120. Note that the options for 1002 can be independently adjusted between the two options of 1003.

Figure 19A:
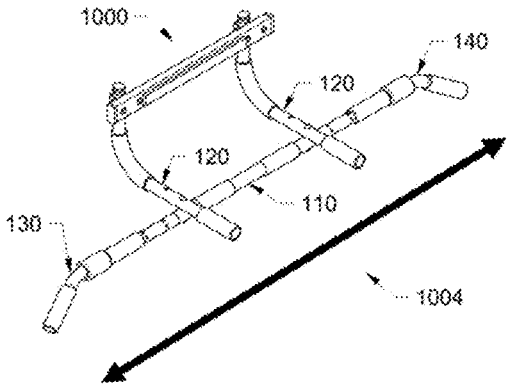
FIG. 19.A shows the FEAYP in the wide door frame configuration.
Figure 19B:
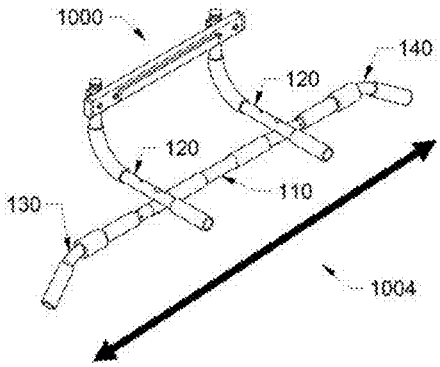
Figure 19C:
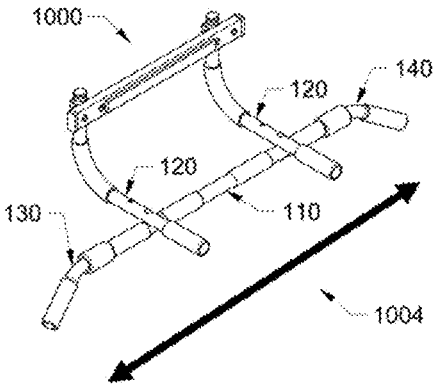

The Door Width Adjustment Mechanism 1004 is displayed in FIGS. 19.A through 19.C. The widest option, shown in FIG. 19.A sets the union between 110 and 130/140 to the most proximal hole of arrays 135/136 and 145/146. Respectively the medium width and narrow width options are displayed by FIG. 19.B and FIG. 19.C by the respective through holes 135/136 and 145/146. It is important to note that 1004 can be adjusted independently of 1003 and 1002 adding to the versatility of 1000.

It should be understood that the invention is not limited in its application to the details of the particular arrangement shown in this disclosure and is well capable of other embodiments different than shown in this disclosure. It should therefore also be understood that the invention is not limited to the embodiment descriptions above but encompasses any and all embodiments within the scope and spirit of the inventions as claimed.

What is claimed is:

1. An apparatus comprising:

a doorway pullup bar comprising:

a first angle bar comprising a plurality of first angle bar holes;

a second angle bar comprising a plurality of second angle bar holes;

a cross-beam bar extending horizontally between the first angle bar and the second angle bar, wherein a first end of the cross-beam bar is attached to an upper portion of the first angle bar and a second end of the cross-beam bar is attached to an upper portion of the second angle bar;

a friction strip attached to an underside surface of the cross-beam bar, wherein the friction strip comprises (i) an elongated strip, (ii) a rectangular strip, or (iii) a plurality of individual strips, and wherein the friction strip includes an abrasive surface facing downward when attached to the underside surface of the cross-beam bar;

a center bar, wherein the first angle bar and the second angle bar are fastenably attached to the center bar such that a cavity is defined between the first angle bar and the second angle bar above a top surface of the center bar, and wherein the first angle bar and the second angle bar are positioned on top of the center bar;

a left hand grip bar removably connected to a first open end of the center bar, the left hand grip bar comprising a first set of holes and a second set of holes formed in an upper surface of the left hand grip bar, wherein the first set of holes and the second set of holes extend in parallel and are spaced apart from each other, wherein the left hand grip bar is insertable into the first open end of the center bar on a left terminal end of the center bar;

a right hand grip bar removably connected to a second open end of the center bar, the right hand grip bar comprising a first set of holes and a second set of holes formed in an upper surface of the right hand grip bar, wherein the first set of holes and the second set of holes of the right hand grip bar extend in parallel and are spaced apart from each other, wherein the right hand grip bar is insertable into the second open end of the center bar on a right terminal end of the center bar;

wherein each of the left hand grip bar and the right hand grip bar includes a straight bar section connected to a bent bar portion that connects to a respective hand grip;

wherein the respective hand grips are angled downward in a standard configuration;

wherein the left hand grip bar and the right hand grip bar are adjustably orientable such that the respective hand grips are selectively adjustable between the standard configuration and a horizontal configuration in which the respective hand grips are not angled downward; and wherein insertion of a first fastener through the second set of holes of the left hand grip bar and insertion of a second fastener through the second set of holes of the right hand grip bar orients the respective hand grips in the horizontal configuration.

2. The apparatus of claim 1, wherein the first fastener is configured to extend through a first angle bar hole of the plurality of first angle bar holes of the first angle bar and to also extend through a left sided hole on the top surface of the center bar, and to also extend through a hole of either the first set of holes or the second set of holes of the left hand grip bar.

3. The apparatus of claim 1, wherein the second fastener is configured to extend through a first angle bar hole of the plurality of second angle bar holes of the second angle bar holes of the second angle bar and to also extend through a right sided hole on the top surface of the center bar, and to also extend through a hole of either the first set of holes or the second set of holes of the right hand grip bar.

4. The apparatus of claim 1, wherein the center bar of the doorway pullup bar is independently adjustable to accommodate a thicker door frame setting or a thinner door frame setting.

* * * * *